US008945249B1

(12) United States Patent
Mukhopadhyay et al.

(10) Patent No.: US 8,945,249 B1
(45) **Date of Patent: *Feb. 3, 2015**

(54) METHODS FOR CHARACTERIZING A POLYCRYSTALLINE DIAMOND ELEMENT BY MAGNETIC MEASUREMENTS

(75) Inventors: Debkumar Mukhopadhyay, Sandy, UT (US); Kenneth E. Bertagnolli, Riverton, UT (US)

(73) Assignee: US Synthetic Corporation, Orem, UT (US)

( * ) Notice: Subject to any disclaimer, the term of this patent is extended or adjusted under 35 U.S.C. 154(b) by 800 days.

This patent is subject to a terminal disclaimer.

(21) Appl. No.: 13/160,729

(22) Filed: Jun. 15, 2011

Related U.S. Application Data

(60) Provisional application No. 61/356,158, filed on Jun. 18, 2010.

(51) Int. Cl.
*B24D 3/00* (2006.01)
*E21B 10/46* (2006.01)

(52) U.S. Cl.
USPC ..... 51/293; 51/307

(58) Field of Classification Search
CPC ..... B24D 3/00; E21B 10/46
See application file for complete search history.

(56) References Cited

U.S. PATENT DOCUMENTS 4,268,276 A 5/1981 Bovenkerk
4,410,054 A 10/1983 Nagel et al.
4,468,138 A 8/1984 Nagel
4,560,014 A 12/1985 Geczy
4,738,322 A 4/1988 Hall et al.
4,811,801 A 3/1989 Salesky et al.
4,913,247 A 4/1990 Jones
5,016,718 A 5/1991 Tandberg
5,092,687 A 3/1992 Hall
5,120,327 A 6/1992 Dennis
5,135,061 A 8/1992 Newton, Jr.
5,154,245 A 10/1992 Waldenstrom et al.
5,158,148 A 10/1992 Keshavan
5,180,022 A 1/1993 Brady
5,364,192 A 11/1994 Damm et al.
5,368,398 A 11/1994 Damm et al.
5,460,233 A 10/1995 Meany et al.
5,480,233 A 1/1996 Cunningham
5,541,006 A 7/1996 Conley
5,544,713 A 8/1996 Dennis
5,697,046 A 12/1997 Conley
5,752,155 A 5/1998 Gates, Jr. et al.
6,793,681 B1 9/2004 Pope et al.
7,377,341 B2 * 5/2008 Middlemiss et al. ..... 175/374

(Continued)

OTHER PUBLICATIONS

Fang Zhigang and Jimmy W. Eason, Nondestructive Evaluation of WN-Co Composites Using Magnetic Properties, The International Journal of Powder Metallurgy, vol. 29, No. 3, 1993, pp. 259-265.
U.S. Appl. No. 61/356,158, filed Jun. 18, 2010, Mukhopadhyay et al.

(Continued)

*Primary Examiner* — Pegah Parvini
(74) *Attorney, Agent, or Firm* — Dorsey & Whitney LLP

(57) ABSTRACT

Embodiments of methods for measuring one or more magnetic characteristics of a polycrystalline diamond ("PCD") element and use of those results to adjust one or more process parameters for fabricating a PCD element and/or for quality control are disclosed. Measurements of one or more magnetic characteristics may be used to adjust process parameters for fabrication of a PCD element to, for example, control catalyst concentration and/or the extent of diamond-to-diamond bonding in the PCD element.

33 Claims, 8 Drawing Sheets

(56) References Cited

U.S. PATENT DOCUMENTS

| | | | | |
|---|---|---|---|---|
| 8,461,832 | B2 * | 6/2013 | Bertagnolli et al. | 324/228 |
| 2010/0084196 | A1 * | 4/2010 | Bertagnolli et al. | 175/428 |
| 2013/0187642 | A1 * | 7/2013 | Bertagnolli et al. | 324/228 |

OTHER PUBLICATIONS

ASTM B887-03 (2008) "Standard Test Method for Determination of Coercivity (Hcs) of Cemented Carbides", April.

ASTM B886-03 (2008), "Standard Test Method for Determination of Magnetic Saturation (Ms) of Cemented Carbides".

* cited by examiner

METHODS FOR CHARACTERIZING A POLYCRYSTALLINE DIAMOND ELEMENT BY MAGNETIC MEASUREMENTS

CROSS-REFERENCE TO RELATED APPLICATIONS

This application claims the benefit of U.S. Provisional Application No. 61/356,158 filed on 18 Jun. 2010, the contents of which are incorporated herein, in their entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented-carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst. Accordingly, diamond grains become mutually bonded to form a matrix of PCD, with interstitial regions between the bonded diamond grains being occupied by the solvent catalyst.

One conventional approach for improving the thermal stability of a PDC is to at least partially remove the metal-solvent catalyst from the PCD table of the PDC by acid leaching. In another conventional approach for forming a PDC, a sintered PCD table may be separately formed in a first HPHT process, the sintered PCD table may be leached to at least partially remove the metal-solvent catalyst from interstitial regions between bonded diamond grains, and the at least partially leached PCD table may be bonded to a substrate in a second HPHT process.

SUMMARY

Embodiments of the invention relate to methods for measuring one or more magnetic characteristics of a PCD element (e.g., a PCD table) and using the measurements to adjust one or more process parameters for fabricating a PCD element and/or for quality control on such a PCD element that are suitable for use in a subterranean drilling apparatus. Measurements of one or more magnetic characteristics may be used to adjust process parameters for fabrication of a PCD element to, for example, accurately control catalyst concentration therein and extent of diamond-to-diamond bonding therethrough, or perform quality control on a PCD element.

In an embodiment, a method includes providing a PCD element, measuring one or more magnetic characteristics of the PCD element, and adjusting one or more process parameters for fabricating the PCD element at least partially based on the one or more of the magnetic characteristics. Suitable examples of the one or more magnetic characteristics that may be measured include, but are not limited to, magnetic saturation and/or coercivity. The method may further include fabricating a second PCD element in an adjusted HPHT process that employs the adjusted one or more process parameters.

Suitable examples of process parameters that may be adjusted based at least partially on the measured one or more magnetic characteristics include, but are not limited to, sintering temperature, sintering pressure, diamond particle size used to form the PCD element, catalyst composition, amount of catalyst used in the fabrication of the PCD element, acid composition used to leach catalyst from the PCD element, pH of an acid composition used to leach catalyst from the PCD element, leaching time used in a leaching process to leach catalyst from the PCD element, leaching temperature used to leach catalyst from the PCD element, leaching pressure used to leach catalyst from the PCD element, or combinations foregoing process parameters.

In another embodiment, a method includes fabricating a PCD element in an HPHT process, at least partially leaching a catalyst from the PCD element to form an at least partially leached PCD element, measuring a magnetic saturation and/or a coercivity of the at least partially leached PCD element, and adjusting one or more process parameters of the HPHT process for fabricating the PCD element at least partially based on the measured magnetic saturation and/or the measured coercivity.

In yet another embodiment, a method includes fabricating a PDC in an HPHT process. The PDC includes a substrate having a PCD table formed thereon. The method further includes separating the PCD table from the substrate, at least partially leaching a catalyst from the PCD table in a leaching process to form a leached region, measuring a magnetic saturation and/or a coercivity of at least the leached region of the PCD table, and adjusting one or more process parameters of at least one of the leaching process or the HPHT process at least partially based on the measured magnetic saturation and/or the measured coercivity.

In still yet another embodiment, a method includes fabricating a PCD element in an HPHT process, at least partially leaching a catalyst from the PCD element to form an at least partially leached PCD element, and measuring one or more magnetic characteristics of the at least partially leached PCD element to determine a catalyst concentration in the at least partially leached PCD element. The method further includes rejecting the at least partially leached PCD element if the measured one or more magnetic characteristics are outside a selected limit or range, or accepting the at least partially leached PCD element if the measured catalyst concentration is less than the selected limit. In another embodiment, the method additionally includes further processing, re-processing, or releasing for use the at least partially leached PCD element if the measured magnetic characteristics are within a selected limit or range. For example, measurements of magnetic saturation may be correlated to catalyst concentration in the at least partially leached PCD element. According to an embodiment, the PCD element may be attached to a new substrate in an HPHT process if the measured catalyst concentration is less than the selected limit.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to methods for measuring one or more magnetic characteristics of a PCD element (e.g., a PCD table). In an embodiment, the results of those measurements may be used to adjust one or more process parameters for fabricating a PCD element. In another embodiment, the results of those measurements may be used for quality control to reject PCD elements that are not suitable for use or accept those PCD elements that are suitable for use. A PCD element includes a plurality of directly bonded-together diamond grains (i.e., diamond-to-diamond bonding) that define a plurality of interstitial regions. A metal-solvent catalyst or other infiltrant (metallic or nonmetallic) occupies at least a portion of the plurality of interstitial regions of the PCD element.

Figure 1:
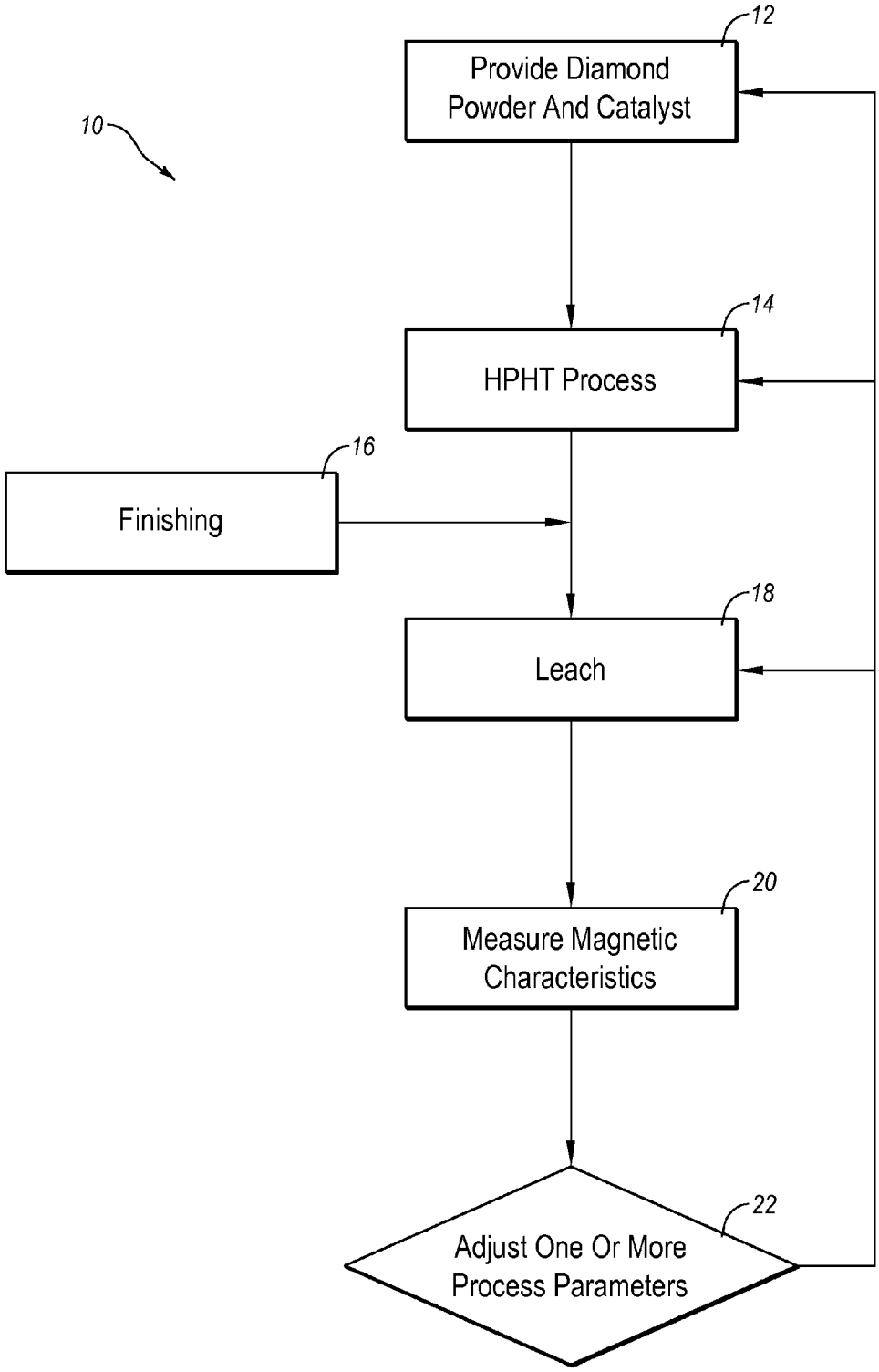
FIG. 1 is a flow diagram illustrating a method for adjusting one or more process parameters used in a method for manufacturing a PCD element according to an embodiment.

Embodiments of Methods for Testing Magnetic Characteristics of a PCD Element Referring now to FIG. 1, a method 10 for adjusting one or more process parameters used in the fabrication of a PCD element is illustrated in accordance with an embodiment. The method 10 includes an act 12 of providing diamond powder and a catalyst and an act 14 of subjecting the diamond powder and the catalyst to a HPHT process to fabricate a PCD element. After act 14, optionally, one or more surfaces of the PCD element may be at least partially finished in act 16 using techniques such as, but not limited to, lapping, centerless grinding, machining (e.g., electro-discharge machining), or combinations of the foregoing finishing processes. For example, in act 16, the PCD element may be shaped to a selected geometry, such shaping to form a disk with an edge chamfer. After either the HPHT process (act 14) or the finishing process (act 16), the PCD element may be at least partially leached in act 18. The leaching may be used to at least partially remove metal-solvent catalyst from the PCD element that was used to catalyze formation of PCD.

As discussed in greater detail below, many metal-solvent catalysts are ferromagnetic and the concentration and/or crystal structure of the metal-solvent catalyst affects the measured magnetic saturation and the measured coercivity of the PCD element. Thus, the measured magnetic saturation may be correlated to concentration of the metal-solvent catalyst in the PCD element, while the measured coercivity may be correlated to the extent of diamond-to-diamond bonding throughout the PCD element.

The method 10 further includes an act 20 of measuring one or more magnetic characteristics (e.g., magnetic saturation and/or coercivity) of the PCD element that may be used to adjust one or more process parameters for fabrication of the PCD element to, for example, adjust the leaching process (act 18), adjust parameters of the HPHT process, adjust the size of the diamond particles provided, or combinations of the foregoing in order to provide accurate control catalyst concentration, the extent of diamond-to-diamond bonding in the PCD element, or combinations of the foregoing. Thus, in act 22, one or more process parameters may be adjusted, such as adjusting the precursor diamond powder and catalyst provided in act 12, the HPHT process parameter used in act 14, the finishing process in act 16, the leaching process in act 18, or combinations of the foregoing. By controlling the catalyst concentration so it is sufficiently low and HPHT process conditions to impart a high-degree of diamond-to-diamond bonding in the PCD element (for a given diamond particle formulation), the PCD element may exhibit one or more improved performance characteristics, such as increased wear resistance, reduced cracking, improved thermal stability, or combinations of the foregoing. A new PCD element may be fabricated using the adjusted process parameters in a modified HPHT process.

For example, at elevated temperature and in the presence of a metal-solvent catalyst, some of the diamond grains in the PCD element may undergo a chemical breakdown or back-conversion to graphite via interaction with the solvent catalyst. At elevated high temperatures, portions of the diamond grains may transform to carbon monoxide, carbon dioxide, graphite, or combinations thereof, causing degradation of the mechanical properties of the PCD table. In another example, high catalyst concentration in the PCD element may reduce thermal stability of the PCD element due to the fact that the diamond grains and the metal-solvent catalyst of the PCD element have different coefficients of thermal expansion that can induce cracking of the PCD element.

In an embodiment, the method 10 includes fabricating a PDC in an HPHT process to form a PCD table bonded to a first substrate. In such an embodiment, a catalyst may be at least partially leached from a PCD table of the PDC in a leaching process to form a leached region, a magnetic saturation and/or a coercivity of at least the leached region of the PCD table may be measured, and one or more process parameters of at least one of the leaching process or the HPHT process may be adjusted at least partially based on the measured magnetic saturation and/or the measured coercivity.

In an embodiment, the method 10 further includes removing the leached region from the PCD table by, for example, grinding away the unleached region. In such an embodiment, measuring one or more of a magnetic saturation or a coercivity of at least the leached region of the PCD table comprises measuring the one or more of the magnetic saturation or the coercivity of only the leached region.

In an embodiment, the first substrate that is bonded to the PCD table includes tungsten carbide, chromium carbide, or combinations thereof cemented with iron, nickel, cobalt, or alloys thereof. For example, the first substrate may comprise cobalt-cemented tungsten carbide.

In an embodiment, the method further includes separating the PCD table from the first substrate, adjusting one or more parameters of the HPHT process at least partially based on the measured magnetic saturation and/or the measured coercivity to make a modified HPHT process, and bonding the PCD table to a second substrate using a modified HPHT process. For example, the second substrate may also comprise tungsten carbide, chromium carbide, or combinations thereof cemented with iron, nickel, cobalt, or alloys thereof, such as a cobalt-cemented tungsten carbide substrate.

In an embodiment, the one or more process parameters affect synthesis of the diamond structure (e.g., the extent of diamond-to-diamond bonding) in the PCD element. In another embodiment, the process parameters affect wear resistance and/or thermal stability of the PCD element. Suitable examples of process parameters that may be adjusted based on one or more of the measured magnetic characteristics include, but are not limited to, HPHT sintering temperature, HPHT sintering pressure, precursor diamond particle size used to form the PCD element, catalyst composition, amount of catalyst used in the fabrication of the PCD element, acid composition used to leach catalyst from the PCD element, pH of an acid composition used to leach catalyst from the PCD element, leaching time used in a leaching process to leach catalyst from the PCD element, leaching temperature used to leach catalyst from the PCD element, leaching pressure used to leach catalyst from the PCD element, combinations thereof, or another suitable process parameter.

In an embodiment, the sintering temperature and/or the sintering pressure may be adjusted to affect the fabrication of the PCD element and/or affect the performance characteristics of the PCD element. As discussed in greater detail below, PCD elements are fabricated by placing diamond particles into an HPHT cell assembly and subjecting the cell assembly and the diamond particles therein to HPHT conditions (e.g., about 1100° C. to about 2200° C., or about 1200° C. to about 1450° C. and a pressure of at least about 5 GPa, 7.5 GPa to about 15 GPa, about 9 GPa to about 12 GPa, or about 10 GPa to about 12.5 GPa) for a time sufficient to sinter the diamond particles together in the presence of a metal-solvent catalyst. The pressure values employed in the HPHT processes disclosed herein refer to the pressure in a pressure transmitting medium of the HPHT cell assembly at room temperature (e.g., about 25° C.) with application of pressure using an ultra-high pressure press and not the pressure applied to the exterior of the cell assembly. The actual pressure in the pressure transmitting medium at sintering temperature may be slightly higher. The metal-solvent catalyst may be infiltrated from substrate placed adjacent the diamond particles, provided from a thin layer of metal-solvent catalyst, mixed with the diamond particles, or combinations of the foregoing. Testing the magnetic characteristics of the PCD element provides a non-destructive testing technique that enables sintering parameters to be adjusted (e.g., raising/lowering the temperature and/or the pressure and/or altering the time in the pressure cell) to affect performance parameters, such as degree of diamond grain growth, extent of diamond-to-diamond bonding, and the concentration of metal-solvent catalyst incorporated into the PCD during the HPHT process.

In another embodiment, the precursor diamond particle size used to form the PCD element may be adjusted based on measured magnetic parameters of fabricated PCD elements. The diamond particles used to fabricate the PCD element may exhibit an average particle size of, for example, about 50 μm or less, such as about 30 μm or less, about 20 μm or less, about 10 μm to about 18 μm or, about 15 μm to about 18 μm. In some embodiments, the average particle size of the diamond particles may be about 10 μm or less, such as about 2 μm to about 5 μm or submicron. It is noted that the sintered diamond grain size in the PCD element may differ from the average particle size of the mass of diamond particles prior to sintering due to a variety of different physical processes, such as grain growth, diamond particle fracturing, carbon provided from another carbon source (e.g., dissolved carbon in the metal-solvent catalyst), or combinations of the foregoing. Measuring the magnetic characteristics of fabricated PCD elements may allow manufacturing processes to be adjusted such that starting diamond particle size is selected in order to achieve desired performance characteristics and/or a selected sintered diamond grain size in the PCD element.

In yet another embodiment, one or more of a catalyst composition, an amount of catalyst used in the fabrication of the PCD element, or a catalyst concentration in the fabricated-unleached PCD element may be measured and adjusted based on the measured magnetic characteristics of the PCD element. Metal-solvent catalyst concentration and/or catalyst composition may affect performance of the PCD elements by affecting, for example, thermal stability of the PCD element, crack resistance, and chemical stability.

Metal-solvent catalyst may be introduced into the PCD element by a number of processes. If, for example, the substrate includes a metal-solvent catalyst, the metal-solvent catalyst may liquefy and infiltrate the mass of precursor diamond particles during the HPHT process to promote growth between adjacent diamond particles of the mass of diamond particles to form the PCD element. For example, if the substrate is a cobalt-cemented tungsten carbide substrate, cobalt from the substrate may be liquefied and infiltrate the mass of diamond particles to catalyze formation of the PCD element. Sintering temperature and/or pressure and precursor diamond particle size may affect the amount of catalyst that infiltrates into the PCD element during the HPHT process.

Catalyst concentration in the PCD element may also be altered on the back end of the process by leaching at least a portion of the catalyst from the PCD element using an acid leaching process. Acid leaching is a time consuming and often difficult process. Monitoring the catalyst concentration in the PCD element before, during, and after the leaching process using the measured magnetic saturation enables the leaching process parameters to be adjusted in order to achieve desired characteristics in the PCD element and/or a selected catalyst concentration in the PCD element after leaching.

In one embodiment, the concentration of catalyst in the PCD element either before or after leaching is less than about 5 weight % ("wt %"). For example, the concentration of catalyst in the PCD element either before or after leaching is less than about 2 wt %, less than about 1 wt %, or about 0.5 wt % to about 1.5 wt %.

Based on the magnetic characteristics of the PCD, one or more of acid composition used to leach catalyst from the PCD element, pH of an acid composition used to leach catalyst from the PCD element, leaching time used in a leaching process to leach catalyst from the PCD element, leaching temperature used to leach catalyst from the PCD element, and leaching pressure used to leach catalyst from the PCD element may be adjusted.

Figure 2:
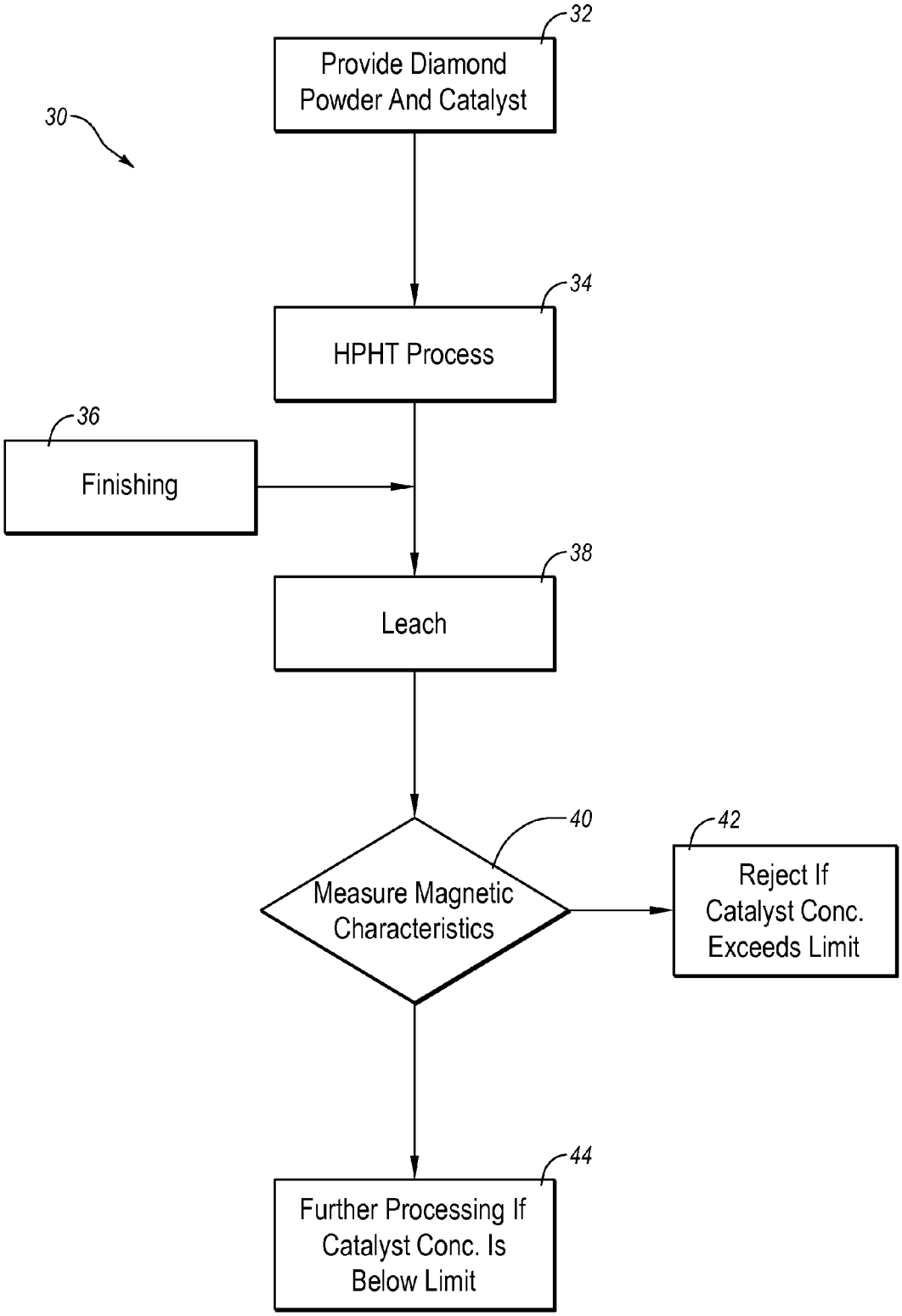
FIG. 2 is a flow diagram illustrating a method for performing quality control on a PCD element according to an embodiment.

Referring now to FIG. 2, a method 30 for performing quality control on a PCD element is illustrated in accordance with an embodiment. In general, the method 30 illustrated in FIG. 2 uses measurements of the magnetic characteristics of PCD elements fabricated in an HPHT process to determine which PCD elements are suitable for further processing, reprocessing, or use. For example, magnetic saturation may be measured and correlated to the concentration of catalyst in the PCD element. As discussed above, catalyst concentration in the PCD element may be used to predict the potential wear resistance and/or thermal stability of the PCD element.

The method 30 includes an act 32 of providing diamond powder and a catalyst and an act 34 of subjecting the diamond powder and the catalyst to an HPHT process to fabricate a PCD element. After the HPHT process, optionally, one or more surfaces of the PCD element may be at least partially finished in act 36 using techniques, such as, lapping, centerless grinding, or machining (e.g., electro-discharge machining). After either the HPHT process or the lapping and centerless grinding, in act 38, the PCD element may be at least partially leached to at least partially remove the metal-solvent catalyst from the PCD element.

After leaching, in act 40, one or more magnetic characteristics such as magnetic saturation and/or coercivity of the PCD element are measured. For example, magnetic saturation of the leached PCD element may be measured and correlated to catalyst concentration in the PCD element. According to an embodiment, in act 42, the PCD element is rejected if the measured catalyst concentration exceeds a selected limit. In an embodiment, one or more process parameters used to fabricate the PCD element may be adjusted in accordance with the method 10 shown in FIG. 1 if the PCD is rejected.

In another embodiment, in act 44, if the catalyst concentration is less than the selected limit, the PCD element may be accepted/deemed to be suitable for further processing. For example, if the PCD element passes magnetic testing, the PCD element may be used as-is, finished using one or more techniques (e.g., lapping, centerless grinding, or electro-discharge machining) or the PCD element may be re-attached to a second substrate (e.g., a cobalt-cemented tungsten carbide substrate) in a second HPHT process.

In one embodiment, the method 30 includes rejecting the at least partially leached PCD element if the measured catalyst concentration is greater than about 5 wt %, greater than about 2 wt %, greater than about 1.5 wt %, greater than about 1.0 wt %, or any selected value between about 1 wt % and about 5 wt %. In other embodiments, the method 30 includes accepting the at least partially leached PCD element if the measured catalyst concentration is less than about 5 wt %, less than about 2 wt %, less than about 1.5 wt %, less than about 1.0 wt %, about 0.5 wt % to about 1.3 wt %, or any selected value between about 0.5 wt % and about 2.0 wt %.

In a more specific embodiment, the method 30 may include fabricating a PCD element on a first substrate in an HPHT process, separating the PCD element from the first substrate, at least partially leaching a metal-solvent catalyst from the separated PCD element to form an at least partially leached PCD element, and measuring a magnetic saturation of the at least partially leached PCD element to determine a catalyst concentration in at least a portion of the at least partially leached PCD element. If the catalyst concentration in the separated PCD element is less than the selected limit, then further processing may include re-attaching the at least partially leached PCD element to a second substrate in a second HPHT process to form a PDC, followed by further processing such as lapping/centerless grinding/machining the PDC, and leaching the re-attached PCD element. For example, during re-attachment of the at least partially leached PCD element, a metallic infiltrant from the second substrate may infiltrate into the interstitial regions between bonded diamond grains of the at least partially leached PCD element, and the metallic infiltrant may be at least partially removed thereafter in a leaching process. In an embodiment, the first substrate that is bonded to the PCD table includes tungsten carbide, chromium carbide, or combinations thereof cemented with iron, nickel, cobalt, or alloys thereof. For example, the first substrate may comprise cobalt-cemented tungsten carbide. For example, the second substrate may also comprise tungsten carbide, chromium carbide, or combinations thereof cemented with iron, nickel, cobalt, or alloys thereof, such as a cobalt-cemented tungsten carbide substrate.

In any of the disclosed embodiments, suitable examples of PCD elements include, but are not limited to, an at least partially leached PCD element and an unleached PCD element, such as an at least partially leached or unleached PCD table that may or may not be attached to a substrate.

Suitable examples of magnetic characteristics that may be measured in any of the disclosed embodiments include, but are not limited to, magnetic saturation (e.g., specific magnetic saturation) and coercivity (e.g., specific coercivity). Magnetic saturation and coercivity may be measured using the example apparatuses and methods described below with respect to FIGS. 3A-4. In an embodiment, a metal-solvent catalyst concentration in the PCD element may be determined at least partially based on the measured magnetic saturation.

In any of the disclosed embodiments, a metal-solvent catalyst concentration in the PCD element may be determined at least partially based on measured magnetic saturation with the measurement performed either before or after a leaching process in which the metal-solvent catalyst is at least partially leached from the PCD element. In an embodiment, the leaching process may include leaching the metal-solvent catalyst from the PCD element to form an at least partially leached PCD element. A suitable example of a leaching process may include immersing the PCD element for a selected period of time at a selected temperature in an acid solution including one or more acids selected from sulfuric acid, hydrochloric acid, nitric acid, aqua regia, hydrofluoric acid, and combinations thereof.

In any of the disclosed embodiments, measuring the one or more magnetic characteristics may include determining an extent of diamond-to-diamond bonding within the PCD element at least partially based on the measured coercivity, such as the measured specific coercivity. Coercivity measurements may be correlated to the extent of diamond-to-diamond bonding by determining the mean free path between neighboring diamond grains in the PCD element. That is, the magnitude of the measured coercivity has an inverse relationship to the mean free path between neighboring diamond grains of the PCD element. The mean free path may correlate to the average distance between neighboring diamond grains of the PCD element, and thus may be indicative of the extent of diamond-to-diamond bonding in the PCD element. A relatively smaller mean free path, in well-sintered PCD, may indicate relatively more diamond-to-diamond bonding.

Embodiments of Magnetic Characterization Techniques for Measuring Magnetic Saturation and/or Coercivity As discussed above, many physical characteristics of a PCD element may be correlated with certain measured magnetic properties of the PCD element because the metal-solvent catalyst therein may be ferromagnetic. For example, the amount of the metal-solvent catalyst present in the PCD element may be correlated with the measured specific magnetic saturation of the PCD element. A relatively larger specific magnetic saturation indicates relatively more metal-solvent catalyst in the PCD element.

The mean free path between neighboring diamond grains of the PCD element may be correlated with the measured coercivity of the PCD element. A relatively large coercivity indicates a relatively smaller mean free path. The mean free path is representative of the average distance between neighboring diamond grains of the PCD element, and thus may be indicative of the extent of diamond-to-diamond bonding in the PCD. A relatively smaller mean free path, in well-sintered PCD, may indicate relatively more diamond-to-diamond bonding. Generally, as the sintering pressure that is used to form the PCD element increases, the coercivity may increase and the magnetic saturation may decrease.

As merely one example, ASTM B886-03 (2008) and ASTM B887-03 (2008) el provide suitable standards for measuring the specific magnetic saturation and the coercivity of the PCD element. Although both ASTM B886-03 (2008) and ASTM B887-03 (2008) el are directed to standards for measuring magnetic properties of cemented carbide materials, either standard may be used to determine the magnetic properties of a PCD element. A KOERZIMAT CS 1.096 instrument (commercially available from Foerster Instruments of Pittsburgh, Pa.) is one suitable instrument that may be used to measure the specific magnetic saturation and the coercivity of a PCD element. However, other commercially available instruments may also be used.

Figure 3A:
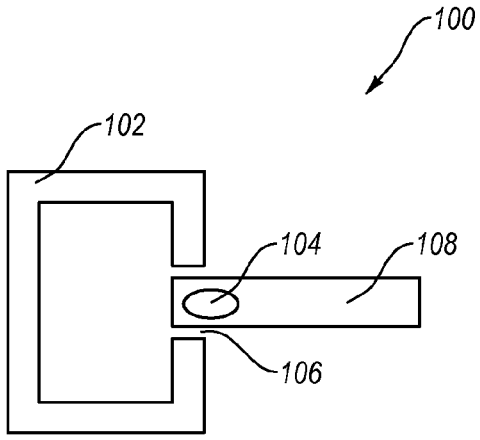
FIG. 3A is a schematic diagram of an example of a magnetic saturation apparatus configured to magnetize a PCD element approximately to saturation for use in practicing the methods shown in FIGS. 1 and 2.
Figure 3B:
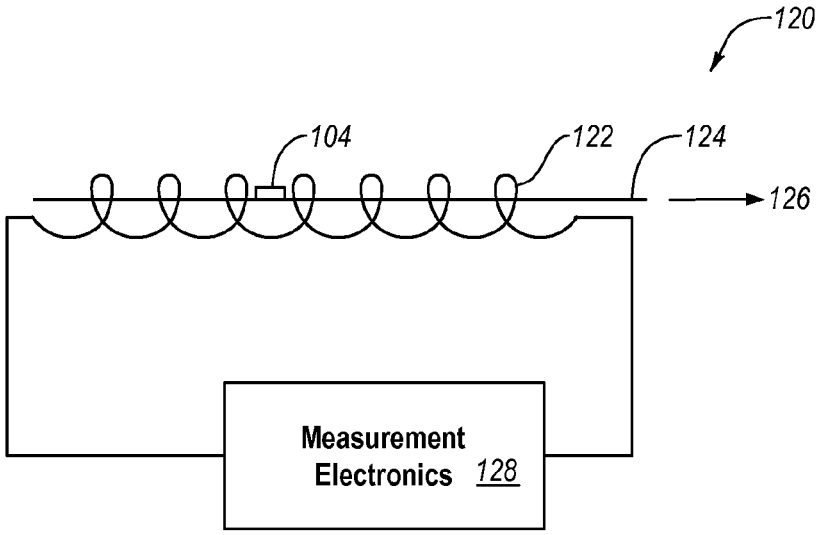
FIG. 3B is a schematic diagram of an example of a magnetic saturation measurement apparatus configured to measure a saturation magnetization of a PCD element for use in practicing the methods shown in FIGS. 1 and 2.
Figure 4:
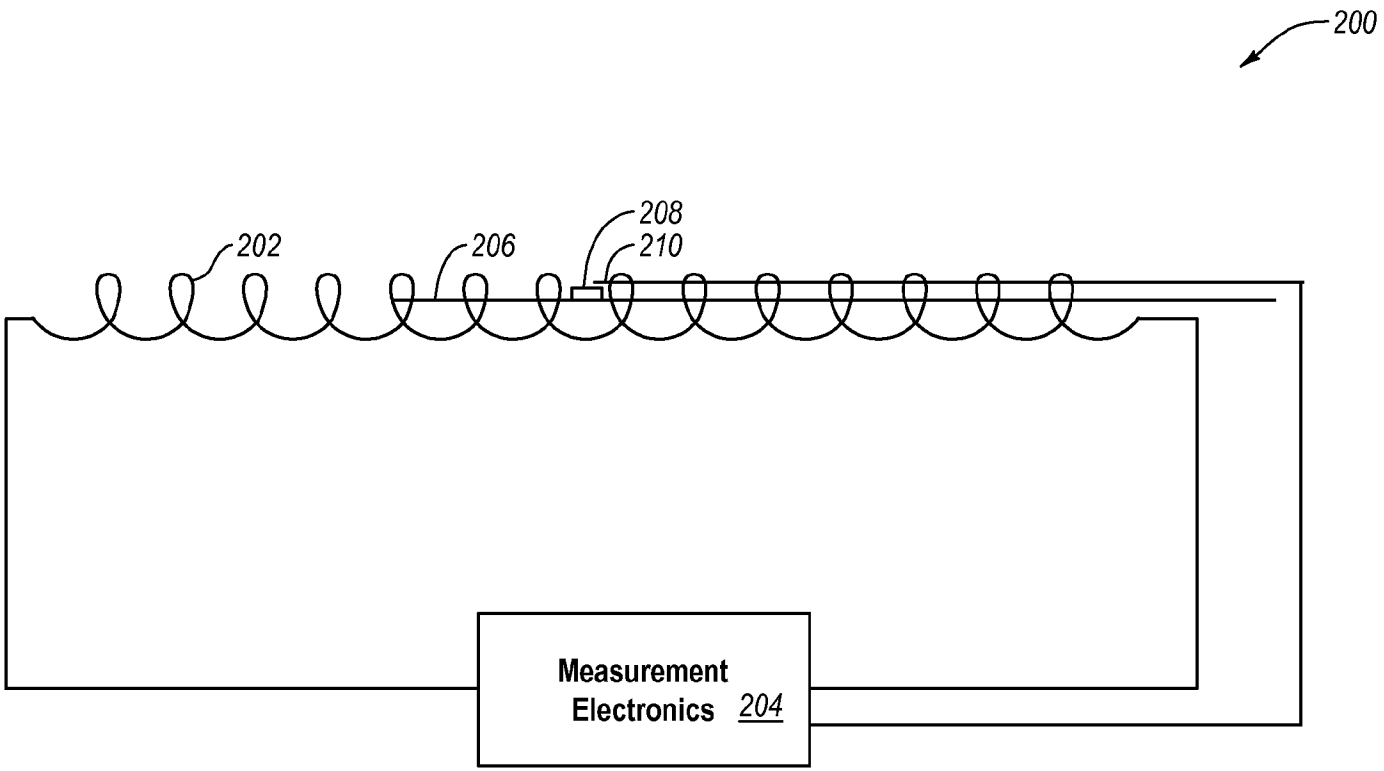
FIG. 4 is a schematic diagram of an example of a coercivity measurement apparatus configured to determine coercivity of a PCD element for use in practicing the methods shown in FIGS. 1 and 2.

FIGS. 3A, 3B, and 4 schematically illustrate the manner in which the specific magnetic saturation and the specific coercivity of the PCD may be determined using an apparatus, such as the KOERZIMAT CS 1.096 instrument. FIG. 3A is a schematic diagram of an example of a magnetic saturation apparatus 100 configured to magnetize a PCD element to saturation. The magnetic saturation apparatus 100 includes a saturation magnet 102 of sufficient strength to magnetize a PCD element 104 to saturation. The saturation magnet 102 may be a permanent magnet or an electromagnet. In the illustrated embodiment, the saturation magnet 102 is a permanent magnet that defines an air gap 106, and the PCD element 104 may be positioned on a sample holder 108 within the air gap 106. When the PCD element 104 is lightweight, it may be secured to the sample holder 108 using, for example, double-sided tape or other adhesive so that the PCD element 104 does not move responsive to the magnetic field from the saturation magnet 102 and the PCD element 104 is magnetized at least approximately to saturation.

Referring to the schematic diagram of FIG. 3B, after magnetizing the PCD element 104 at least approximately to saturation using the magnetic saturation apparatus 100, a magnetic saturation of the PCD element 104 may be measured using a magnetic saturation measurement apparatus 120. The magnetic saturation measurement apparatus 120 includes a Helmholtz measuring coil 122 defining a passageway dimensioned so that the magnetized PCD sample 104 may be positioned therein on a sample holder 124. Once positioned in the passageway, the sample holder 124 supporting the magnetized PCD sample 104 may be moved axially along an axis direction 126 to induce a current in the Helmholtz measuring coil 122. Measurement electronics 128 are coupled to the Helmholtz measuring coil 122 and configured to calculate the magnetic saturation based upon the measured current passing through the Helmholtz measuring coil 122. The measurement electronics 128 may also be configured to calculate a weight percentage of magnetic material in the PCD element 104 when the composition and magnetic characteristics of the metal-solvent catalyst in the PCD element 104 are known, such as with iron, nickel, cobalt, and alloys thereof. Specific magnetic saturation may be calculated based upon the calculated magnetic saturation and the measured weight of the PCD element 104.

The amount of metal-solvent catalyst in the PCD element 104 may be determined using a number of different analytical techniques and correlated with the measured specific magnetic saturation. For example, energy dispersive spectroscopy (e.g., EDAX), wavelength dispersive x-ray spectroscopy (e.g., WDX), Rutherford backscattering spectroscopy, or combinations thereof may be employed to determine the amount of metal-solvent catalyst in the PCD element 104.

If desired, a specific magnetic saturation constant of the metal-solvent catalyst content in the PCD element 104 may be determined using an iterative approach. A value for the specific magnetic saturation constant of the metal-solvent catalyst in the PCD element 104 may be iteratively chosen until a metal-solvent catalyst content calculated by the analysis software of the KOERZIMAT CS 1.096 instrument using the chosen value substantially matches the metal-solvent catalyst content determined via one or more analytical techniques, such as energy dispersive spectroscopy, wavelength dispersive x-ray spectroscopy, or Rutherford backscattering spectroscopy.

FIG. 4 is a schematic diagram of a coercivity measurement apparatus 200 configured to determine a coercivity of a PCD element. The coercivity measurement apparatus 200 includes a coil 202 and measurement electronics 204 coupled to the coil 202. The measurement electronics 204 are configured to pass a current through the coil 202 so that a magnetic field is generated. A sample holder 206 having a PCD element 208 thereon may be positioned within the coil 202. A magnetization sensor 210 configured to measure a magnetization of the PCD element 208 may be coupled to the measurement electronics 204 and positioned in proximity to the PCD element 208.

During testing, the magnetic field generated by the coil 202 magnetizes the PCD element 208 at least approximately to saturation. Then, the measurement electronics 204 apply a current so that the magnetic field generated by the coil 202 is increasingly reversed. The magnetization sensor 210 measures a magnetization of the PCD element 208 resulting from application of the reversed magnetic field to the PCD element 208. The measurement electronics 204 determine the coercivity of the PCD element 208, which is a measurement of the strength of the reversed magnetic field at which the magnetization of the PCD element 208 is zero.

Embodiments for Fabricating PCD Elements, PDCs, and Resulting Structures

The PCD elements characterized by the disclosed magnetic characterization techniques may be formed by sintering a mass of a plurality of diamond particles in the presence of a metal-solvent catalyst. The diamond particles may exhibit an average particle size of about 50 μm or less, such as about 30 μm or less, about 20 μm or less, about 10 μm to about 18 μm or, about 15 μm to about 18 μm. In some embodiments, the average particle size of the diamond particles may be about 10 μm or less, such as about 2 μm to about 5 μm or submicron.

In an embodiment, the diamond particles of the mass of diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the mass of diamond particles may include a portion exhibiting a relatively larger size (e.g., 30 μm, 20 μm, 15 μm, 12 μm, 10 μm, 8 μm) and another portion exhibiting at least one relatively smaller size (e.g., 6 μm, 5 μm, 4 μm, 3 μm, 2 μm, 1 μm, 0.5 μm, less than 0.5 μm, 0.1 μm, less than 0.1 μm). In one embodiment, the mass of diamond particles may include a portion exhibiting a relatively larger size between about 10 μm and about 40 μm and another portion exhibiting a relatively smaller size between about 1 μm and 4 μm. In some embodiments, the mass of diamond particles may comprise three or more different sizes (e.g., one relatively larger size and two or more relatively smaller sizes), without limitation.

It is noted that the as-sintered diamond grain size may differ from the average particle size of the mass of diamond particles prior to sintering due to a variety of different physical processes, such as grain growth, diamond particle fracturing, carbon provided from another carbon source (e.g., dissolved carbon in the metal-solvent catalyst), or combinations of the foregoing. The metal-solvent catalyst (e.g., iron, nickel, cobalt, or alloys thereof) may be provided in particulate form mixed with the diamond particles, as a thin foil or plate placed adjacent to the mass of diamond particles, from a cemented carbide substrate including a metal-solvent catalyst, or combinations of the foregoing.

In order to efficiently sinter the mass of diamond particles, the mass may be enclosed in a pressure transmitting medium, such as a refractory metal can, graphite structure, pyrophyllite, combinations thereof, or other suitable pressure transmitting structure to form a cell assembly. The cell assembly, including the pressure transmitting medium and mass of diamond particles therein, is subjected to an HPHT process using an ultra-high pressure press at a temperature of at least about 1000° C. (e.g., about 1100° C. to about 2200° C., or about 1200° C. to about 1450° C.) and a pressure in the pressure transmitting medium of at least about 5 GPa (e.g., about 5 GPa, 7.5 GPa to about 15 GPa, about 9 GPa to about 12 GPa, or about 10 GPa to about 12.5 GPa) for a time sufficient to sinter the diamond particles together in the presence of the metal-solvent catalyst and form the PCD element comprising directly bonded-together diamond grains defining interstitial regions occupied by the metal-solvent catalyst. For example, the pressure in the pressure transmitting medium employed in the HPHT process may be at least about 5 GPa, at least about 7.5 GPa, at least about 8.0 GPa, at least about 9.0 GPa, at least about 10.0 GPa, at least about 11.0 GPa, at least about 12.0 GPa, or at least about 14 GPa. The pressure values employed in the HPHT processes disclosed herein refer to the pressure in the pressure transmitting medium at room temperature (e.g., about 25° C.) with application of pressure using an ultra-high pressure press and not the pressure applied to exterior of the cell assembly. The actual pressure in the pressure transmitting medium at sintering temperature may be slightly higher.

In an embodiment, the magnetic characterization techniques described above may be used to characterize the PCD element and adjust the HPHT process and precursor materials used to fabricate the PCD element to obtain a PCD element with specific performance characteristics such as thermal stability, wear resistance, among other characteristics. In another embodiment, the magnetic characterization techniques described above may be used to characterize the PCD element and determine which PCD elements are suitable for further processing and which should be rejected. In one embodiment described in greater detail above, PCD elements having a catalyst concentration that exceeds a selected limit may be rejected from further processing.

After fabricating the PCD element, the metal-solvent catalyst may be leached from the PDC element, if desired, via an acid leaching process. The magnetic characterization methods described above may be used to characterize the PCD element before and/or after leaching, such as the amount of metal-solvent catalyst remaining after leaching, and adjust the HPHT process, precursor materials, leaching process, or combinations thereof in order to design a process by which a selected amount of the metal-solvent catalyst remains after leaching.

Figure 5A:
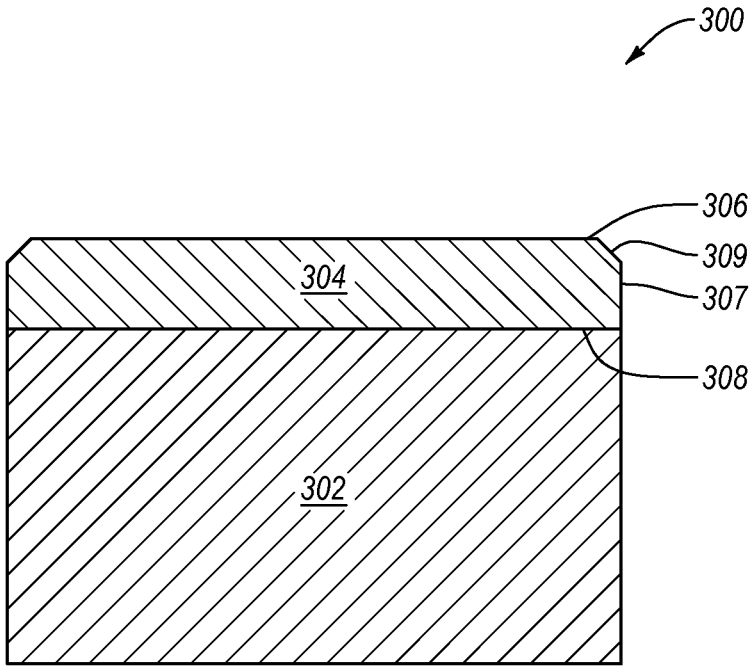
FIG. 5A is a cross-sectional view of an embodiment of a PDC.

Referring to FIG. 5A, the PCD elements may be employed in a PDC for cutting applications, bearing applications, or many other applications. FIG. 5A is a cross-sectional view of an embodiment of a PDC 300. The PDC 300 includes a substrate 302 bonded to a PCD table 304. The PCD table 304 may be formed of PCD in accordance with any of the PCD embodiments disclosed herein. The PCD table 304 exhibits at least one working surface 306 and at least one lateral dimension "D" (e.g., a diameter). Although FIG. 5A shows the working surface 306 as substantially planar, the working surface 306 may be concave, convex, or another nonplanar geometry. Furthermore, other regions of the PCD table 304 may function as a working region, such as a peripheral side surface and/or an edge 307 and/or an optional chamfer 309 that extends between the working surface 306 and the peripheral side surface 307. The substrate 302 may be generally cylindrical or another selected configuration, without limitation. Although FIG. 5A shows an interfacial surface 308 of the substrate 302 as being substantially planar, the interfacial surface 308 may exhibit a selected nonplanar topography, such as a grooved, ridged, or other nonplanar interfacial surface. The substrate 302 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in one embodiment, the substrate 302 comprises cobalt-cemented tungsten carbide.

Figure 5B:
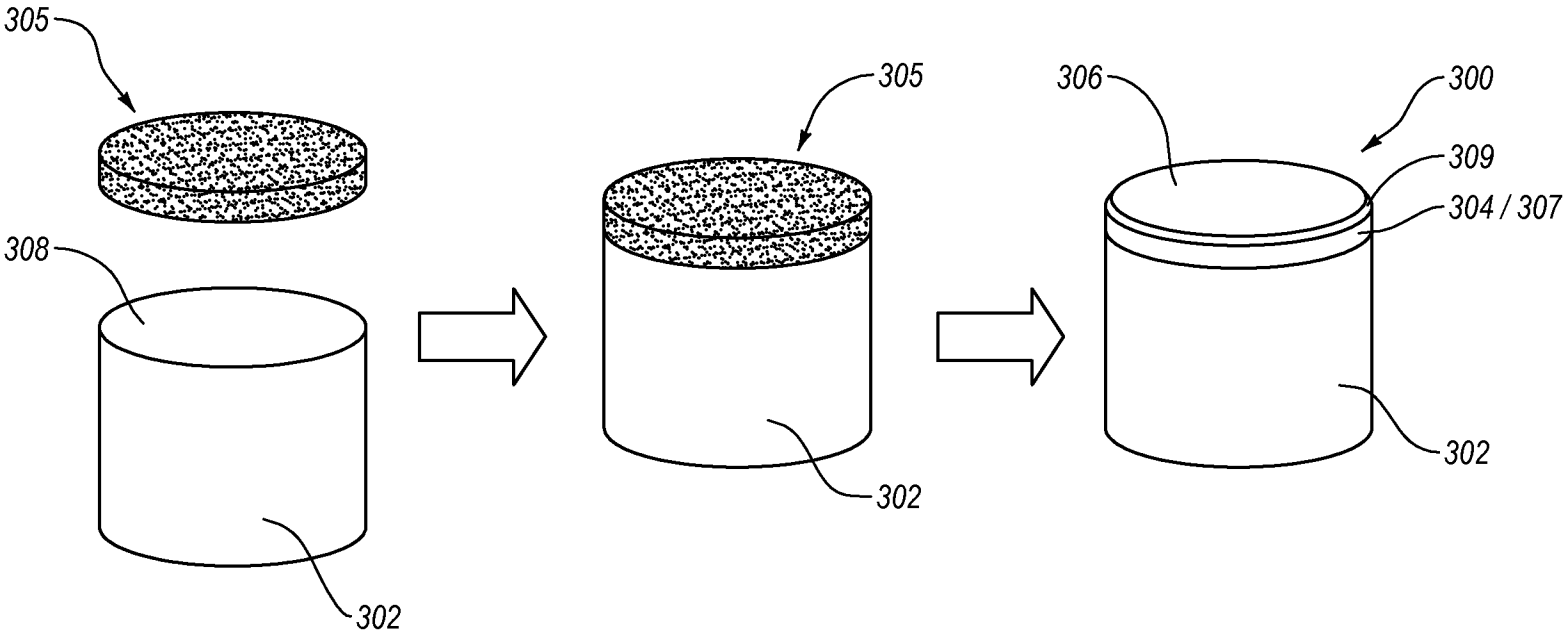
FIG. 5B is a schematic illustration of a method of fabricating the PDC shown in FIG. 5A according to an embodiment.

FIG. 5B is a schematic illustration of an embodiment of a method for fabricating the PDC 300 shown in FIG. 5A. Referring to FIG. 5B, a diamond volume 305 is positioned adjacent to the interfacial surface 308 of the substrate 302. For example, the diamond volume 305 may be an at least partially leached PCD table or a mass of diamond particles having any of the above-mentioned average particle sizes and distributions (e.g., an average particle size of about 50 μm or less). As previously discussed, the substrate 302 may include a metal-solvent catalyst. The diamond volume 305 and substrate 302 may be subjected to an HPHT process using any of the conditions previously described with respect to sintering the PCD elements disclosed herein. The PDC 300 so-formed includes the PCD table 304 bonded to the interfacial surface 308 of the substrate 302. If the substrate 302 includes a metal (e.g., a metal-solvent catalyst) and the diamond volume 305 is a mass of diamond particles, the metal may liquefy and infiltrate the mass of diamond particles to promote growth between adjacent diamond particles of the mass of diamond particles to form the PCD table 304 comprised of a body of bonded diamond grains having the infiltrated metal interstitially disposed between bonded diamond grains. For example, if the substrate 302 is a cobalt-cemented tungsten carbide substrate, cobalt from the substrate 302 may be liquefied and infiltrate the mass of diamond particles of the PCD table 304.

In other embodiments, the diamond volume 305 is a PCD table that was separately formed using an HPHT sintering process (i.e., a pre-sintered PCD table) and, subsequently, bonded to the interfacial surface 308 of the substrate 302 by brazing, using a separate HPHT bonding process, or any other suitable joining technique, without limitation.

In any of the embodiments disclosed herein, substantially all or a selected portion of the metal-solvent catalyst may be removed (e.g., via leaching) from the PCD table 304. In an embodiment, metal-solvent catalyst in the PCD table 304 may be removed to a selected depth from at least one exterior working surface (e.g., the working surface 306 and/or a side-wall working surface of the PCD table 304) so that only a portion of the interstitial regions are occupied by metal-solvent catalyst. For example, substantially all or a selected portion of the metal-solvent catalyst may be removed from the PCD table 304 of the PDC 300 to a selected depth from the working surface 306.

In some embodiments, the PCD table 304 may be separated from the substrate 302. The separated PCD table may be tested to measure any of the magnetic characteristics disclosed herein. The HPHT process, precursor diamond particles, metal-solvent catalyst, or combinations of the foregoing may be modified based at least partially on the measured magnetic characteristics.

In another embodiment, a PCD table may be fabricated in a first HPHT process, leached to remove substantially all of the metal-solvent catalyst from the interstitial regions between the bonded diamond grains, and subsequently bonded to a substrate in a second HPHT process. For example, the PCD table may be at least partially leached to remove metal-solvent catalyst therefrom, characterized by one or more of the disclosed magnetic characterization techniques, and the first HPHT process, precursor materials, and leaching process may be adjusted to obtain an at least partially leached PCD table with a controlled amount of residual metal-solvent catalyst therein.

In the second HPHT process, an infiltrant from, for example, a cemented carbide substrate may infiltrate into the interstitial regions from which the metal-solvent catalyst was depleted of a PCD table that was fabricated using an adjusted manufacturing process chosen at least partially based on the measured magnetic characteristics of other PCD tables. For example, the infiltrant may be cobalt that is swept-in from a cobalt-cemented tungsten carbide substrate. In one embodiment, the infiltrant may be leached from the infiltrated PCD table using a second acid leaching process following the second HPHT process.

Applications for PCD Elements and PDCs

The PCD elements and PDCs that have been fabricated by a process that has been adjusted at least partially based on the disclosed magnetic characterization techniques may be used in a number of different applications including, but not limited to, use in a rotary drill bit, a thrust-bearing apparatus, a radial bearing apparatus, a subterranean drilling system, and a wire-drawing die. The various applications discussed above are merely some examples of applications in which the PCD elements and PDCs may be used. Other applications are contemplated, such as employing the disclosed PCD elements and PDCs in friction stir welding tools.

Figure 6A:
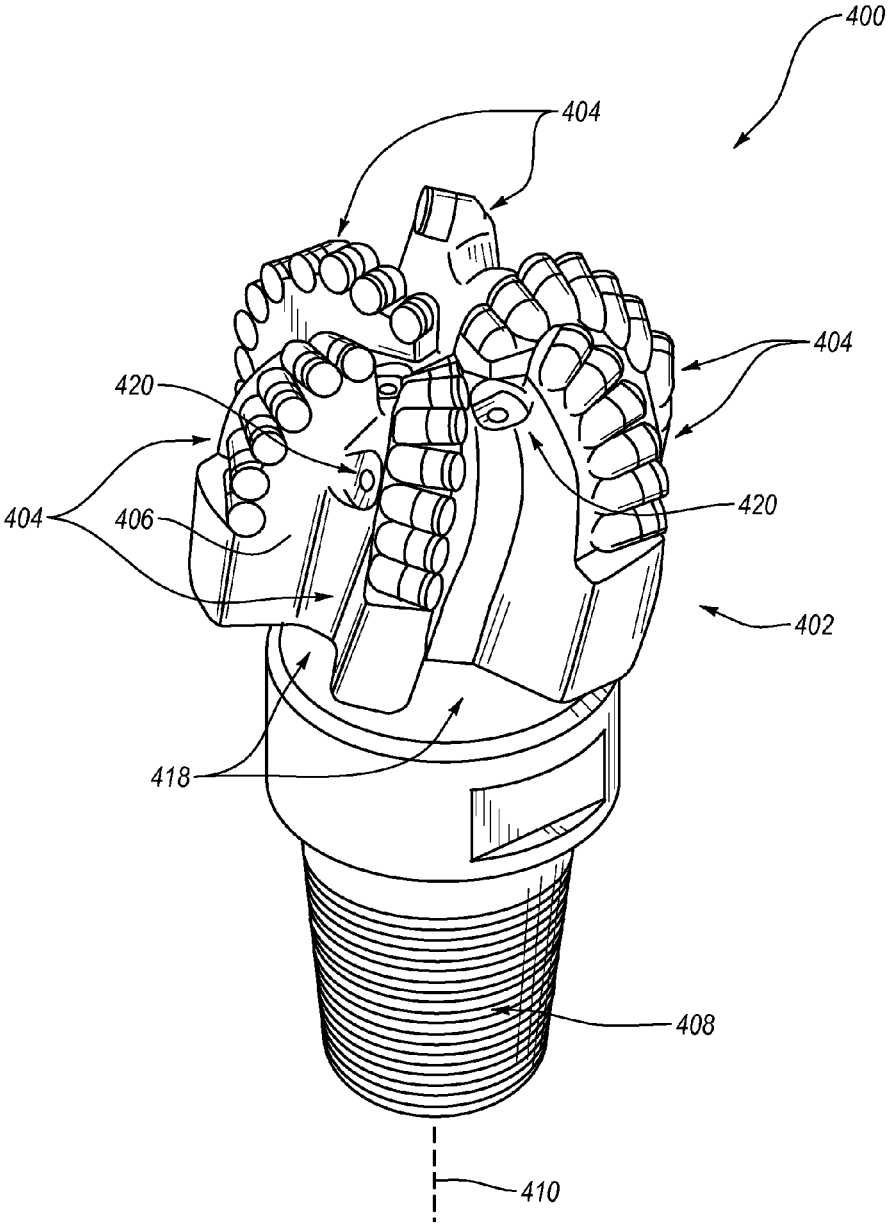
FIG. 6A is an isometric view of an embodiment of a rotary drill bit that may employ one or more of the PDCs that have been fabricated by a process described herein.
Figure 6B:
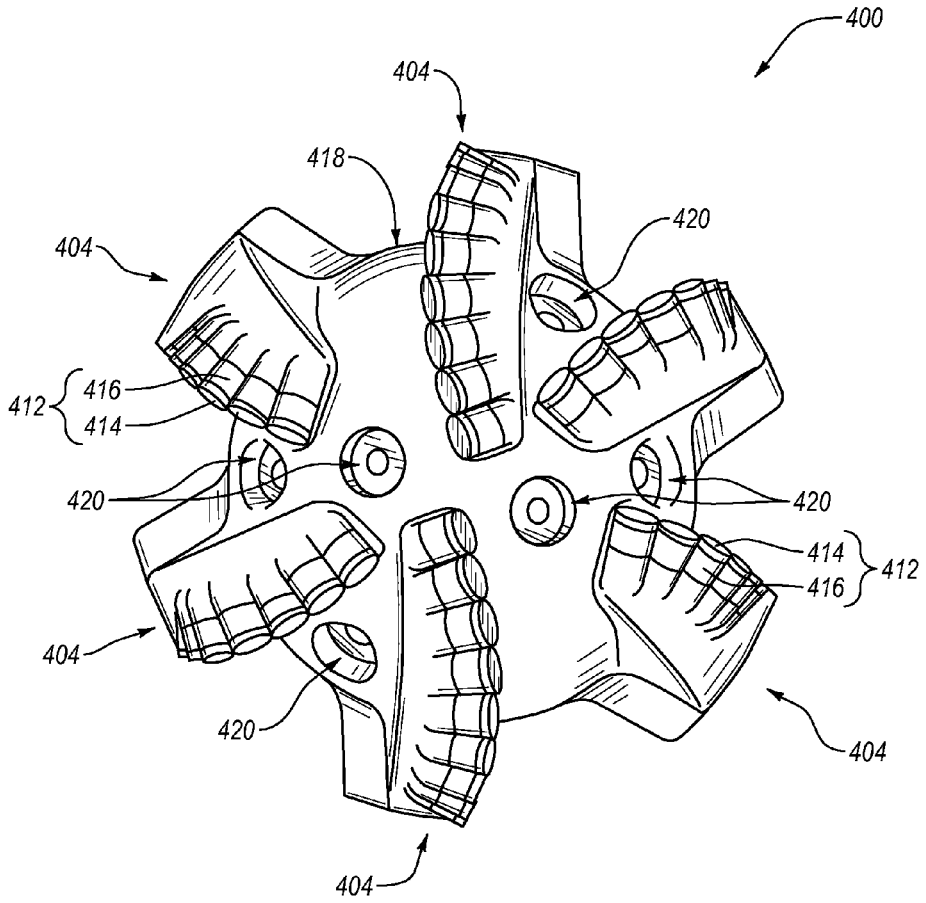
FIG. 6B is a top elevation view of the rotary drill bit shown in FIG. 6A.

FIG. 6A is an isometric view and FIG. 6B is a top elevation view of an embodiment of a rotary drill bit 400. The rotary drill bit 400 includes at least one PDC configured according to any of the previously described PDC embodiments. The rotary drill bit 400 comprises a bit body 402 that includes radially and longitudinally extending blades 404 with leading faces 406, and a threaded pin connection 408 for connecting the bit body 402 to a drilling string. The bit body 402 defines a leading end structure for drilling into a subterranean formation by rotation about a longitudinal axis 410 and application of weight-on-bit. At least one PDC cutting element, such as the PDC 300 shown in FIG. 5A, may be affixed to the bit body 402. With reference to FIG. 6B, a plurality of PDCs 412 are secured to the blades 404. For example, each PDC 412 may include a PCD table 414 bonded to a substrate 416. Also, circumferentially adjacent blades 404 define so-called junk slots 418 therebetween, as known in the art. Additionally, the rotary drill bit 400 may include a plurality of nozzle cavities 420 for communicating drilling fluid from the interior of the rotary drill bit 400 to the PDCs 412.

FIGS. 6A and 6B merely depict an embodiment of a rotary drill bit that employs at least one cutting element comprising a PDC, without limitation. The rotary drill bit 400 is used to represent any number of earth-boring tools or drilling tools, including, for example, core bits, roller-cone bits, fixed-cutter bits, eccentric bits, bicenter bits, reamers, reamer wings, or any other downhole tool including PDCs, without limitation.

The PCD elements and/or PDCs disclosed herein (e.g., the PDC 300 shown in FIG. 5A) may also be utilized in applications other than rotary drill bits. For example, the disclosed PDC embodiments may be used in thrust-bearing assemblies, radial bearing assemblies, wire-drawing dies, artificial joints, machining elements, and heat sinks.

Thus, the embodiments of PCD elements and/or PDCs disclosed herein may be used in any apparatus or structure in which at least one conventional PDC is typically used. In one embodiment, a rotor and a stator, assembled to form a thrust-bearing apparatus, may each include one or more PCD elements and/or PDCs configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing the PCD elements and/or PDCs disclosed herein may be incorporated. The embodiments of PCD elements and/or PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PCD elements and/or PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method for adjusting one or more process parameters for fabricating a polycrystalline diamond ("PCD") element for use in a subterranean drilling apparatus, the method comprising:

providing the PCD element;

measuring one or more of magnetic characteristics of the PCD element; and adjusting the one or more process parameters for fabricating the PCD element at least partially based on the one or more of the magnetic characteristics.

2. The method of claim 1 wherein the PCD element is selected from the group consisting of an at least partially leached PCD element and an unleached PCD element.

3. The method of claim 1 wherein the measured one or more magnetic characteristics include at least one of magnetic saturation or coercivity.

4. The method of claim 3, further comprising determining a catalyst concentration in the PCD element at least partially based on the measured magnetic saturation.

5. The method of claim 4 wherein determining a catalyst concentration in the PCD element at least partially based on measured magnetic saturation is performed either before or after a leaching process in which a catalyst is at least partially leached from the PCD element.

6. The method of claim 3, further comprising determining an extent of diamond-to-diamond bonding within the PCD element at least partially based on the measured coercivity.

7. The method of claim 1 wherein the one or more process parameters affect synthesis of a diamond structure of the PCD element.

8. The method of claim 1 wherein the process parameters affect at least one of wear resistance or thermal stability of the PCD element.

9. The method of claim 1 wherein adjusting one or more process parameters for fabricating the PCD element based on one or more of the measured magnetic characteristics comprises adjusting sintering temperature, sintering pressure, diamond particle size used to form the PCD element, catalyst composition, amount of catalyst used in the fabrication of the PCD element, acid composition used to leach catalyst from the PCD element, pH of an acid composition used to leach catalyst from the PCD element, leaching time used in a leaching process to leach catalyst from the PCD element, leaching temperature used to leach catalyst from the PCD element, leaching pressure used to leach catalyst from the PCD element, or combinations thereof.

10. The method of claim 1, further comprising fabricating a second PCD element in an adjusted high-pressure, high-temperature process that employs the adjusted one or more process parameters.

11. A method for adjusting one or more process parameters for fabricating a polycrystalline diamond ("PCD") element for use in a subterranean drilling apparatus, the method comprising:

fabricating the PCD element in a high-pressure, high-temperature ("HPHT") process;

at least partially leaching a catalyst from the PCD element to form an at least partially leached PCD element;

measuring one or more of a magnetic saturation or a coercivity of the PCD element; and adjusting the one or more process parameters of the HPHT process for fabricating the PCD element at least partially based on one or more of the measured magnetic saturation or the measured coercivity.

12. The method of claim 11 wherein fabricating a PCD element in an HPHT process includes sintering diamond powder in the presence of a catalyst.

13. The method of claim 11 wherein at least partially leaching a catalyst from the PCD element to form an at least partially leached PCD element comprises immersing the PCD element for a selected period of time at a selected temperature in an acid solution including one or more acids selected from the group consisting of sulfuric acid, hydrochloric acid, nitric acid, aqua regia, hydrofluoric acid, and combinations thereof.

14. The method of claim 11, further comprising determining a catalyst concentration in the PCD element at least partially based on the measured magnetic saturation.

15. The method of claim 14 wherein determining a catalyst concentration in the PCD element at least partially based on measured magnetic saturation is performed either before or after the leaching.

16. The method of claim 11, further comprising determining an extent of diamond-to-diamond bonding within the PCD element at least partially based on the measured coercivity.

17. The method of claim 11 wherein the one or more process parameters affect synthesis of a diamond structure of the PCD element.

18. The method of claim 11 wherein the process parameters affect at least one of wear resistance or thermal stability of the PCD element.

19. The method of claim 11 wherein adjusting one or more process parameters for fabricating the PCD element based on one or more of the measured magnetic saturation or the measured coercivity comprises adjusting sintering temperature, sintering pressure, diamond particle size used to form the PCD element, catalyst composition, amount of catalyst used in the fabrication of the PCD element, acid composition used to leach catalyst from the PCD element, pH of an acid composition used to leach catalyst from the PCD element, leaching time used in a leaching process to leach catalyst from the PCD element, leaching temperature used to leach catalyst from the PCD element, leaching pressure used to leach catalyst from the PCD element, or combinations thereof.

20. A method for adjusting one or more process parameters for fabricating a polycrystalline diamond compact ("PDC") for use in a subterranean drilling apparatus, the method comprising:

fabricating the PDC in a high-pressure, high-temperature ("HPHT") process, wherein the PDC includes a substrate having a polycrystalline diamond ("PCD") table formed thereon;

separating the PCD table from the substrate;

at least partially leaching a catalyst from the PCD table in a leaching process to form a leached region;

measuring one or more of a magnetic saturation or a coercivity of at least the leached region of the PCD table; and adjusting the one or more process parameters of at least one of the leaching process or the HPHT process at least partially based on one or more of the measured magnetic saturation or the measured coercivity.

21. The method of claim 20, further comprising:

removing the leached region from the PCD table; and wherein measuring one or more of a magnetic saturation or a coercivity of at least the leached region of the PCD table comprises measuring the one or more of the magnetic saturation or the coercivity of only the leached region.

22. The method of claim 20 wherein the one or more process parameters affect synthesis of a diamond structure of the PCD table.

23. The method of claim 20 wherein the process parameters affect at least one of wear resistance or thermal stability of the PCD table.

24. The method of claim 20 wherein adjusting one or more process parameters for fabricating the PCD element based on one or more of the measured magnetic saturation or the measured coercivity comprises adjusting sintering temperature, sintering pressure, diamond particle size used to form the PCD element, catalyst composition, amount of catalyst used in the fabrication of the PCD element, acid composition used to leach catalyst from the PCD element, pH of an acid composition used to leach catalyst from the PCD element, leaching time used in a leaching process to leach catalyst from the PCD element, leaching temperature used to leach catalyst from the PCD element, leaching pressure used to leach catalyst from the PCD element, or combinations thereof.

25. The method of claim 20, further comprising bonding the PCD table to a second substrate using a modified HPHT process.

26. A method of performing quality control on a polycrystalline diamond ("PCD") element for use in a subterranean drilling apparatus, the method comprising:

fabricating the PCD element in a high-pressure, high-temperature ("HPHT") process;

at least partially leaching a catalyst from the PCD element to form an at least partially leached PCD element;

measuring a magnetic saturation of the at least partially leached PCD element to determine a catalyst concentration in at least a portion of the at least partially leached PCD element; and rejecting the at least partially leached PCD element if the measured catalyst concentration exceeds a selected limit, or accepting the at least partially leached PCD element if the measured catalyst concentration is less than the selected limit.

27. The method of claim 26, further comprising rejecting the at least partially leached PCD element if the measured catalyst concentration is greater than about 5 weight %.

28. The method of claim 26, further comprising rejecting the at least partially leached PCD element if the measured catalyst concentration is greater than about 2 weight %.

29. The method of claim 26, further comprising rejecting the at least partially leached PCD element if the measured catalyst concentration is greater than about 1 weight %.

30. The method of claim 26, further comprising accepting the at least partially leached PCD element if the measured catalyst concentration is less than about 1.5 weight %.

31. The method of claim 26 wherein at least partially leaching a catalyst from the PCD element to form an at least partially leached PCD element comprises immersing the PCD element for a selected period of time at a selected temperature in an acid solution including one or more acids selected from the group consisting of sulfuric acid, hydrochloric acid, nitric acid, aqua regia, hydrofluoric acid, and combinations thereof.

32. The method of claim 26, further comprising attaching the at least partially leached PCD element to a substrate if the measured catalyst concentration is less than the selected limit.

33. The method of claim 26, further comprising adjusting one or more process parameters for fabricating the PCD element at least partially based on the one or more of the magnetic characteristics if the measured catalyst concentration is greater than a selected limit.

* * * * *